US011850599B2

(12) United States Patent
Lewin

(10) Patent No.: US 11,850,599 B2
(45) Date of Patent: Dec. 26, 2023

(54) MOUNTING RING INSTALLATION SYSTEM FOR A MEAT GRINDING SYSTEM

(71) Applicant: Jesse James Lewin, Manchester, IA (US)

(72) Inventor: Jesse James Lewin, Manchester, IA (US)

( * ) Notice: Subject to any disclaimer, the term of this patent is extended or adjusted under 35 U.S.C. 154(b) by 105 days.

(21) Appl. No.: 17/207,366

(22) Filed: Mar. 19, 2021

(65) Prior Publication Data

US 2021/0291194 A1 Sep. 23, 2021

Related U.S. Application Data

(60) Provisional application No. 62/992,608, filed on Mar. 20, 2020.

(51) Int. Cl.
*B02C 18/30* (2006.01)

(52) U.S. Cl.
CPC ..... *B02C 18/305* (2013.01); *B02C 18/301* (2013.01)

(58) Field of Classification Search
CPC ..... B02C 18/301; B02C 18/305; B02C 18/30; B02C 18/36; B02C 18/302
See application file for complete search history.

(56) References Cited

U.S. PATENT DOCUMENTS 3,730,444 A * 5/1973 Pattillo ..... B02C 18/36 241/82.5
7,766,264 B2 * 8/2010 Lesar ..... B02C 18/305 241/82.6
7,946,517 B2 * 5/2011 Lesar ..... B02C 18/302 241/82.5
8,286,902 B2 * 10/2012 Lesar ..... B02C 18/302 241/82.5
8,584,978 B2 * 11/2013 Lesar ..... B02C 18/305 241/82.5
8,794,553 B2 * 8/2014 York ..... B02C 18/301 241/24.26
9,539,580 B2 * 1/2017 Metcalf ..... B02C 18/302
10,363,563 B2 * 7/2019 Norberg ..... B02C 18/305
11,278,909 B2 * 3/2022 King ..... B02C 23/14
2014/0299686 A1 * 10/2014 Jenkins ..... B02C 18/301 241/246
2015/0196039 A1 * 7/2015 Wolff ..... A22C 17/0026 425/281
2016/0030943 A1 * 2/2016 York ..... B02C 18/301 241/30
2016/0051990 A1 * 2/2016 Joechner ..... B02C 18/302 241/86.1
2016/0143484 A1 * 5/2016 Palmer ..... B02C 18/305 241/82.1
2017/0106376 A1 * 4/2017 Quadrana ..... A23L 13/65

* cited by examiner

*Primary Examiner* — Faye Francis

(74) *Attorney, Agent, or Firm* — SHUTTLEWORTH & INGERSOLL, PLC; Elizabeth L. Souer

(57) ABSTRACT

A mounting ring installation system including a torque multiplier introduced to a grinder head to aid in the installation and removal of the mounting ring which holds the grinding plate system securely into the grinder head. The torque multiplying device can have multiple sources of input power including human power or a mechanical source and can be installed on a variety of grinder types and sizes.

20 Claims, 11 Drawing Sheets

MOUNTING RING INSTALLATION SYSTEM FOR A MEAT GRINDING SYSTEM

The present application claims priority to provisional patent application 62/992,608 which was filed on Mar. 20, 2020, and is hereby expressly incorporated by reference in its entirety.

BACKGROUND OF THE INVENTION

The present invention relates to a grinding head of a meat grinder, and more particularly, relates to providing a safer, more efficient way of assembling and disassembling a meat grinder, with the addition of a torque multiplier system either powered by a person operating the meat grinder or by an additional mechanical source to loosen and tighten the mounting ring of the grinder.

The general structure of a grinding machine is common in design. Typically, a grinding machine includes a hopper into which a material to be ground is placed; a grinder portion, including a grinding head, a grinding knife and orifice plate assembly; a mounting ring; a bridge; and a collection tube. A feed screw is typically located within the grinding head to advance the material in the hopper through the grinding head. A knife assembly is mounted at the end of the feed screw and rotates with the feed screw and in combination with the orifice plate. The knife assembly typically serves to grind material that is advanced toward the orifice plate by the feed screw. The feed screw may include a bore downstream and into which a center pin is inserted. The center pin extends through a central passage of the knife assembly and through a bushing that is positioned in a central opening of the orifice plate. A collection cone or pipe is located downstream of the orifice plate and secured to the bushing. The orifice plate is comprised of an outer section having a plurality of grinding apertures and an inner section having at least one collection passage. The collection passage or passages of the orifice plate lead to a collection structure defined by the collection cone which generally includes a collection cavity and a discharge passage. An orifice plate guard is generally located downstream from the orifice plate and maintains the collection structure in place. A mounting ring typically holds the guard against the orifice plate and mounts intervening structures to the body of the grinding head. As is known by one skilled in the art, the mounting ring is commonly loosened and tightened by the person assembling and disassembling the grinder throughout a production cycle to meet safety and regulatory standards. The tool used to loosen and tighten the mounting ring is normally comprised of a long handle, which is normally tubular in shape with a component or components attached to the end of the handle that fit within or over a portion of the mounting ring. This tool is manually maneuvered in a strenuous pushing or pulling motion to tighten and loosen the mounting ring.

Improvements in grinding machines are generally directed at one of five goals: (1) improve separation of hard materials from useable materials and increased output of useable materials; (2) ease of assembly and reassembly of the grinding head; (3) operator safety; (4) reduction of costs in terms of replacement parts; and (5) increase in production rate of product produced within the grind process.

The amount of meat or other ground products produced by the grinder and grinding facility is limited by multiple factors. One factor is the limitation in the physical size and mechanical design of the grinder itself. Another factor is the amount of production time in a production day as well as the amount of time it takes to assemble and disassemble the production equipment while meeting safety and regulatory standards in the food production process.

Because grinding machines are intended for use with food products, frequent assembly and disassembly is required for maintaining inspection and sanitation standards. The various parts of the grinding machine must therefore be readily disassembled and accurately reassembled for maximum efficiency. However, the ease of assembly must be balanced with the benefit of larger grinding machines, which can grind greater quantities of meat efficiently. Features that improve an operator's ability to disassemble the grinder parts and that assure proper safe reassembly of the parts are therefore highly desirable.

Naturally, operator safety is a top priority for owners and operators of meat grinders alike. Features which would improve safety, especially when those improvements do not detract from overall cost or efficiency, are also desirable.

Finally, various processes to assemble the grinding machine subject owners and operators to strenuous physical movements. The environment in which grinding machines operate creates tight working spaces with multiple pinch points, as well as floors, parts and assembly tools that are slippery in nature creating an unstable work environment. Features which reduce assembly and disassembly time, the need for strenuous movements, and improve operator safety are highly desirable.

The features disclosed herein improve meat grinder operator safety, greatly reduce the strenuous physical movements required during assembly and disassembly of the grinder head, and decrease the amount of production time used during the assembly and disassembly processes in order to improve production efficiencies.

SUMMARY OF THE INVENTION

The meat grinding system disclosed herein includes a torque multiplier introduced to a primary grinder head assembly to aid in the installation and removal of the mounting ring which holds the grinding plate system securely into the grinder head. The torque multiplier can have multiple sources of input power including human power or a mechanical source.

BRIEF DESCRIPTION OF THE DRAWINGS

The Description of the Preferred Embodiments will be getter understood with reference to the following figures.

DETAILED DESCRIPTION OF THE PREFERRED EMBODIMENTS OF THE INVENTION

Figure 1:
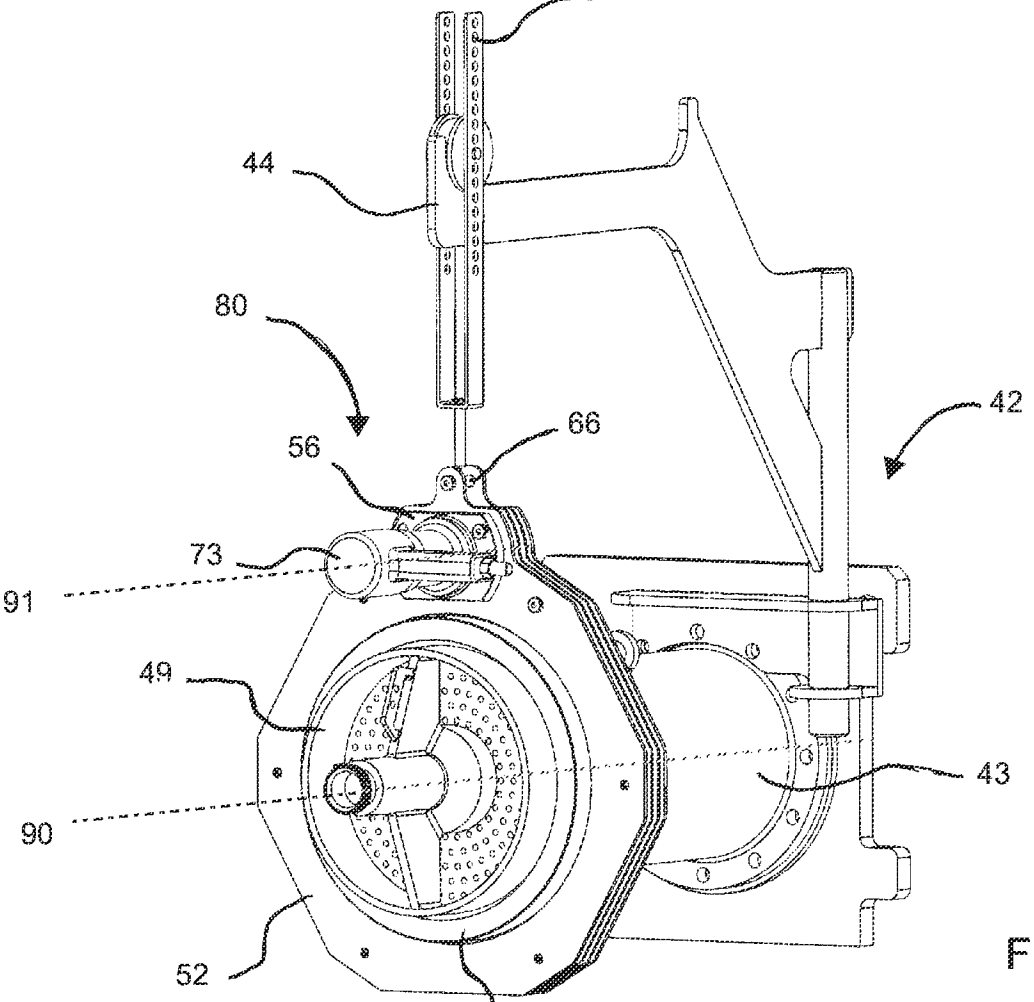
FIG. 1 is the perspective view of the primary grinder system 42 with the mounting ring installation system 80 installed.

Turning first to FIG. 1, there is illustrated a primary meat grinding system 42 with a Safe Tight mounting ring installation system 80 attached.

Figure 3:
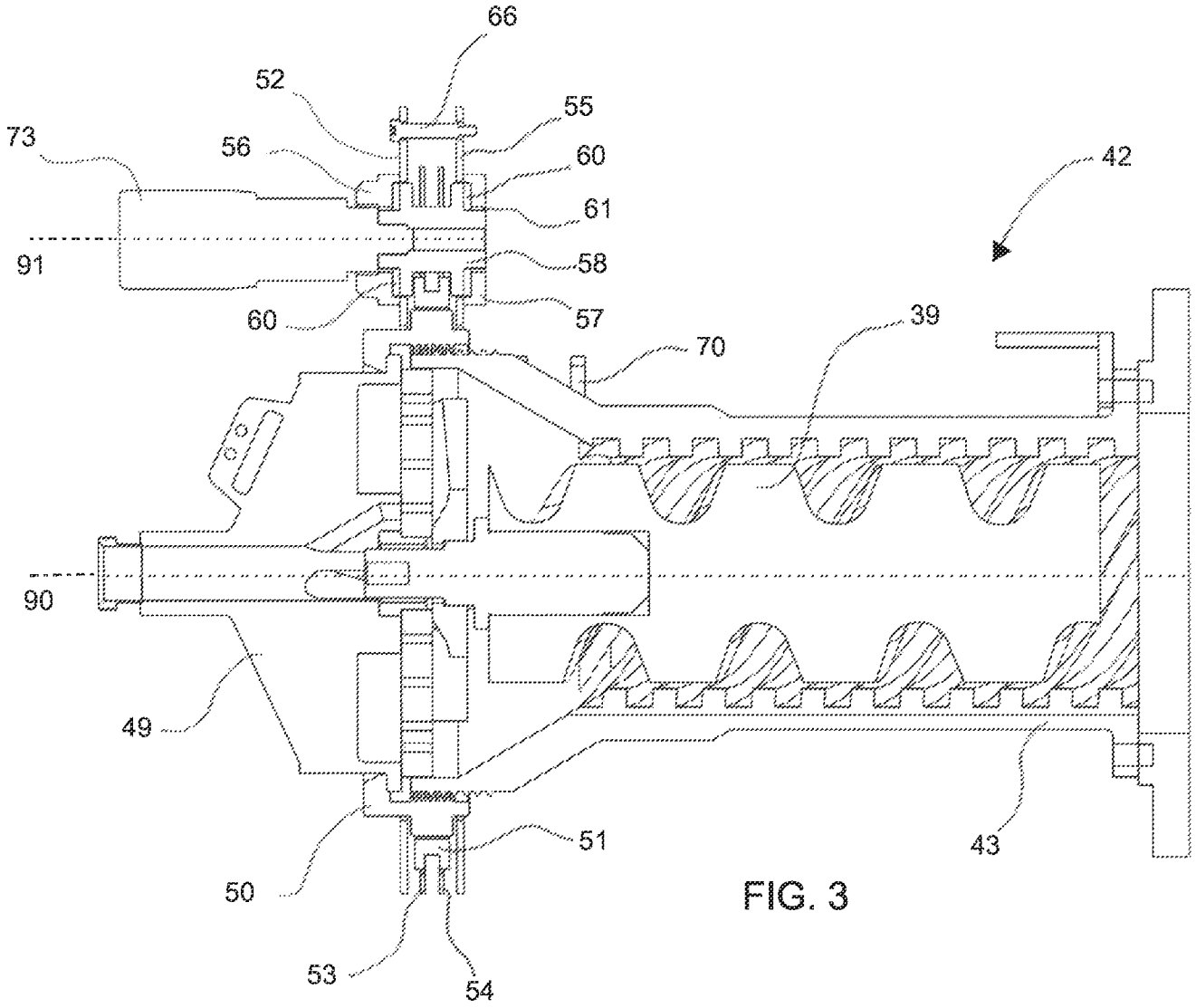
FIG. 3 is a section view of the primary grinder system 42 with the mounting ring installation system 80 installed.
Figure 4:
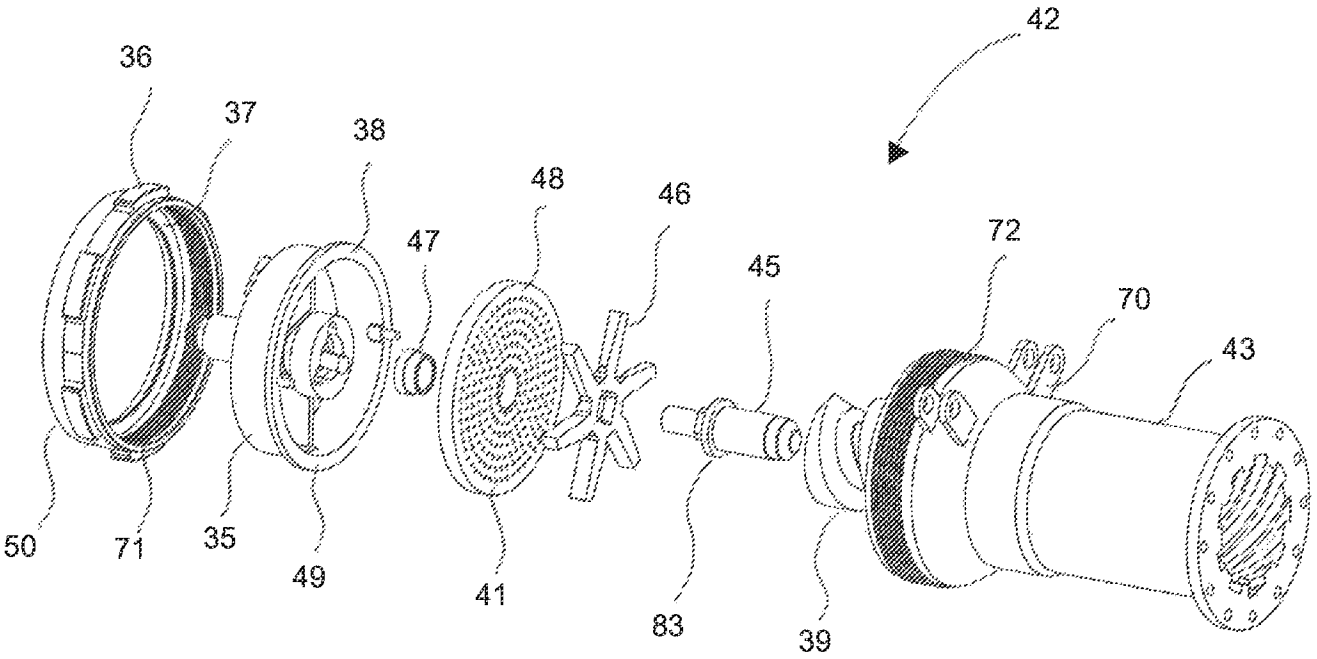
FIG. 4 is a rear side exploded view of the primary grinder system 42.

The primary meat grinding system 42 and its components are more clearly shown in FIG. 4. FIG. 4 shows the primary meat grinding system 42 comprising a grinder head 43, auger 39 (FIG. 3), support pin 45, knife spring 83, knife 46, bushing 47, orifice plate 48, bridge 49, and a mounting ring 50, which, when fixedly attached to the grinder head 43, secures the components therein. The primary meat grinding system 42 may be electrically powered by an electric motor or any other power means that is known by one skilled in the art. In the preferred embodiment the electric motor is a single speed motor. The primary function of the primary meat grinding system 42 is to transfer large portions of meat through the primary meat grinding system 42 to portion the meat into smaller pieces. The large portions of meat may be transferred through the grinder head 43 by the auger 39 that is rotating. The helical auger blades of the auger 39 act as a screw conveyor to advance the meat through the grinder head 43. As the auger 39 continues to rotate, the meat is continually advanced by the helical auger blades toward the knife 46 and the orifice plate 48 depicted in FIG. 4 exerting pressure on the meat. The knife 46 may be rotatably driven by the support pin 45, and the support pin 45 rotatably driven by the auger 39. As pressure is exerted on the meat, the meat will be forced against the orifice plate 48 into the series of orifices 41 in the orifice plate 48. While the meat is forced into the orifices 41, the knife 46 is rotated by the support pin 45 and the meat is cut into small cylindrical portions in comparison to the shape and size of the orifices 41. As the portioned meat exits the orifice plate 48 the exerted pressure from the meat behind the portioned meat is forced through openings in the bridge 49. The portioned meat exits the bridge 49 and is conveyed away by optional sources that are known by persons skilled in the art.

The pressure exerted on the meat and ultimately against the orifice plate 48 is also exerted against the mounting ring 50. The mounting ring 50 has a primary purpose of retaining the components within the primary grinder system 42 and a secondary purpose of generating pressure between the orifice plate 48 and knife 46 with forces applied by knife spring 83. This pressure between the orifice plate 48 and the knife 46 is required in the system to provide a clean cut as the meat is forced into the orifices 41 of the orifice plate 48 and the knife 46 sweeps across the orifices 41. Proper pressure exerted by knife spring 83 on knife 46 and orifice plate 48 is a critical component in the meat portioning process and is known by one skilled in the art. In accordance with the known construction, the end of grinder head 43 may be provided with a series of external threads 72 and the mounting ring 50 may include a series of internals threads 71 adapted to engage the external threads 72 of grinder head 43. A mounting ring 50 may further include an opening defining an inner lip 37. While the mounting ring may be secured by a threaded connection between the internal threads 71 of the mounting ring 50 and the external threads 72 of the grinder head 43, it is understood that the mounting ring 50 and grinder head 43 may be secured together in any satisfactory manner.

Figure 11:
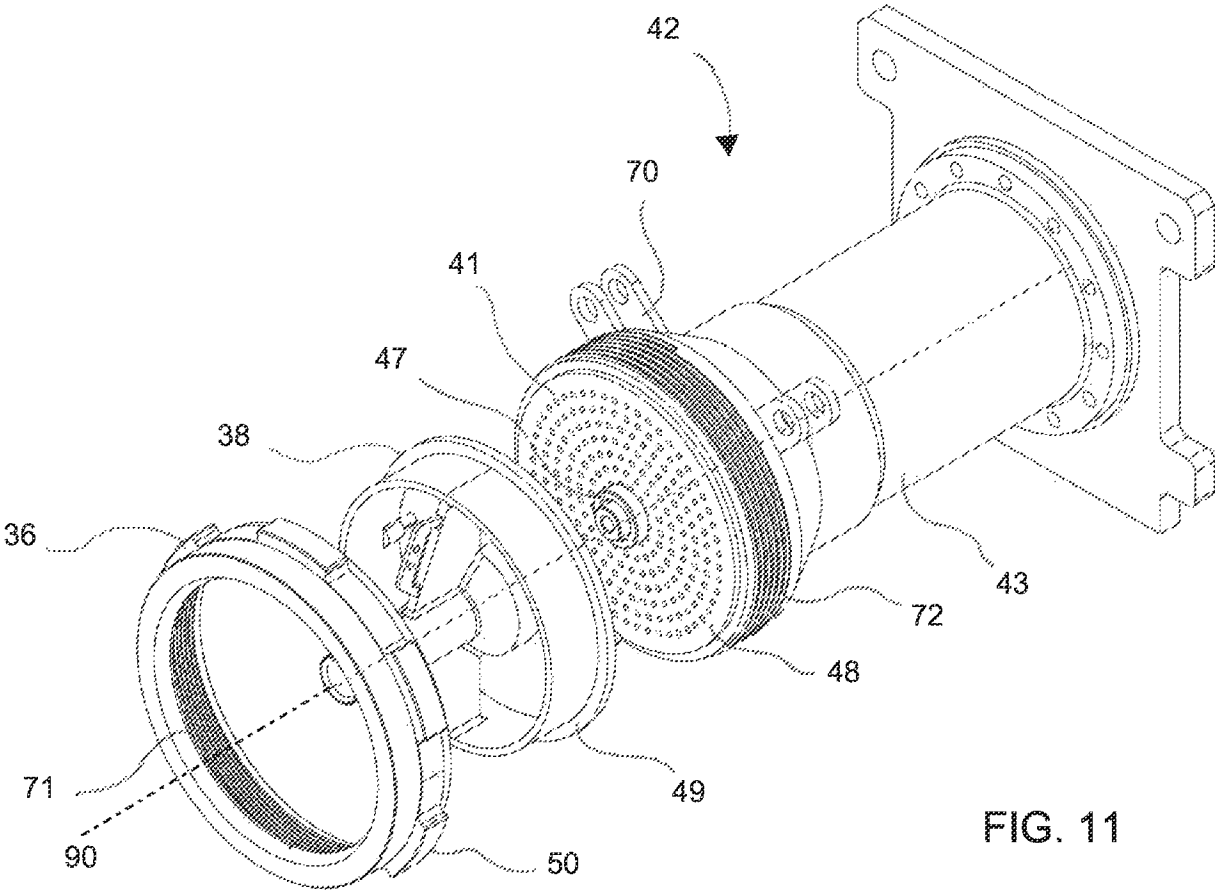
FIG. 11 is a front right perspective view of the primary grinder system illustrating the relationship between orifice plate 48 and grinder head 43.

The bridge 49 may include an outer plate maintaining portion 38 and an inner collection assembly maintaining portion 35 as shown in FIG. 4. The outer plate maintaining portion 38 of bridge 49 may include an outwardly extending shoulder 37 adapted to fit within lip 37 of mounting ring 50, wherein the outer plate maintaining portion 38 is held within mounting ring 50 and engages an outer peripheral portion of orifice plate 48 to maintain orifice plate 48 in position within the open end of grinder head 43 as most clearly seen in FIG. 11.

As previously stated above, mounting ring 50 is fastened to grinder head 43 by external threads 72 on grinder head 43 and internal threads 71 on mounting ring 50. The fastening of these two components is achieved by rotating mounting ring 50 around a central axis 90 of the grinder head 43. When a rotational force is applied to mounting ring 50 about the central axis 90, external threads 72 and internal threads 71 create a mechanical force upon bridge bearing surface 38 with mounting ring shoulder 37 to hold orifice plate 48 properly in place.

Figure 7:
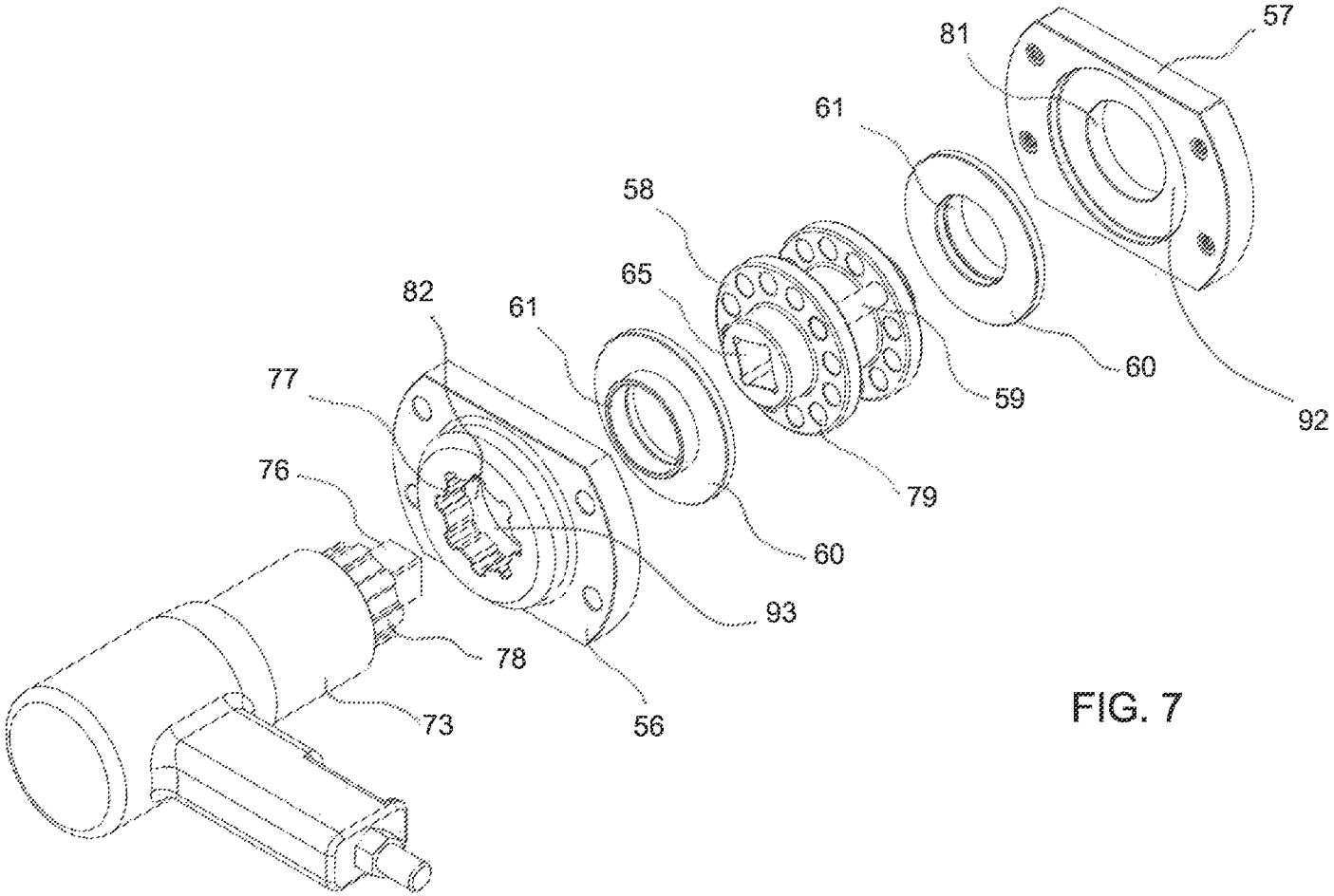
FIG. 7 is an exploded view of the front bearing plate 56 and rear bearing plate 57 and their relationship to the pin gear hub 58.

The rotational force applied to the mounting ring 50 around the central axis 90 of grinder head 43 is disclosed below. In one embodiment, the mounting ring installation system 80 includes a spanner ring 51 with spanner teeth 81 located at the radially outer surface of the spanner ring 51. At least one chosen from a circumferential, a linear, and a tangential force may be applied to the spanner teeth 81 to rotate the spanner ring 51 about the central axis 90 of the grinder head 43. In one embodiment, the rotational force applied to the spanner ring 51 is supplied by a rotation of a pin gear hub 58. As shown in FIG. 7, a rotational force may be introduced to the pin gear hub 58 to cause a rotation of the mounting ring 50 about the central axis 90 of the grinder head 43. The pin gear hub 58 may include at least one hub pin 59, which rotates about an axis of the rotation 91 of the pin gear hub 58. The hub pin 59 of the pin gear hub 58 engages with spanner teeth 81 of the spanner ring 51 to rotate the spanner ring 51 about the central axis 90 of the grinder head 43, and wherein the spanner ring 51 is engaged with the mounting ring 50 such that a rotation of the spanner ring 51 rotates the mounting ring 50 about the central axis 90 of the grinder head 43.

Figure 6:
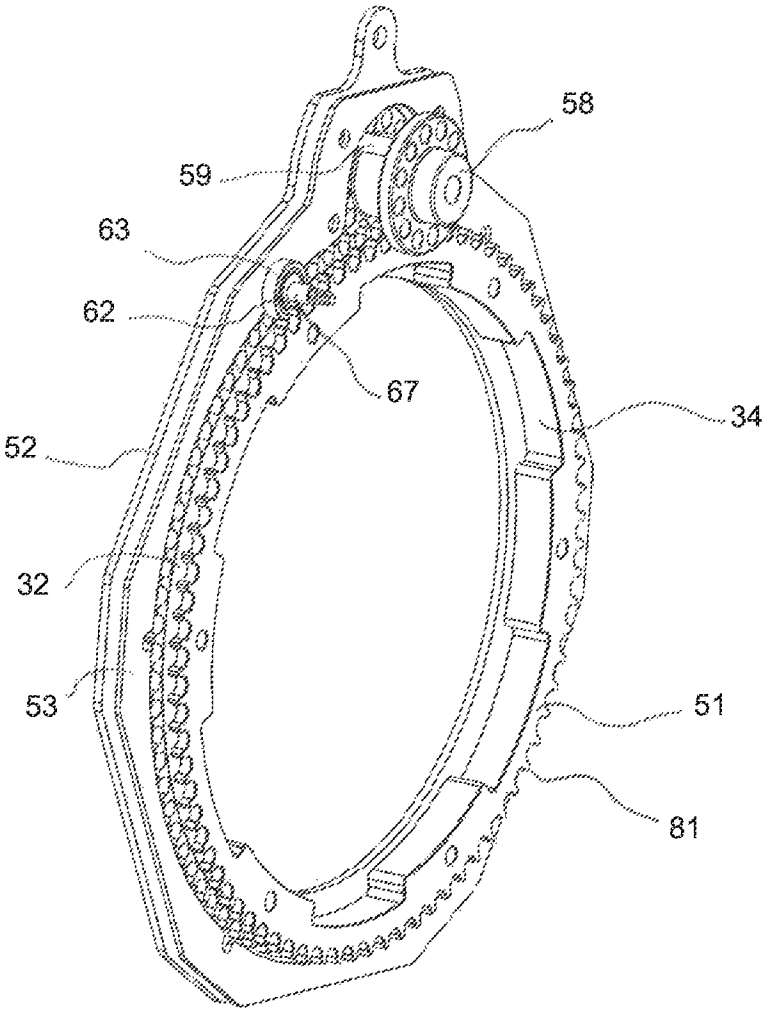
FIG. 6 is a rear side perspective view of the relationship between the spanner ring 51 and the sprocket bearings 63.

The pin gear hub 58 may be located radially outside of and axially adjacent to the mounting ring 50, and may rotate about an axis of rotation 91 located radially outside of the mounting ring 50. When a rotational force is applied to pin gear hub 58 around the rotational axis 91 of the pin gear hub 58, the hub pin 59 rotates about the rotational axis 91 and makes contact with spanner ring 51 and spanner teeth 81, applying a rotational force to the spanner teeth 81. In one embodiment the rotational force may be applied to the side of spanner teeth 81 causing spanner ring 51 to rotate in a direction around the central axis 90 of the grinder head 43 which is opposite to the direction of rotation of the grinder head 43. As shown in FIG. 6, spanner ring 51 may include spanner holes and may be positioned around the central axis 90 of grinder head 43 by a series of spanner bearings 63. Spanner bearings 63 may be faceted in place by spanner bolts 67, one for each of the spanner holes located around the central axis 90 of grinder head 43.

Figure 2:
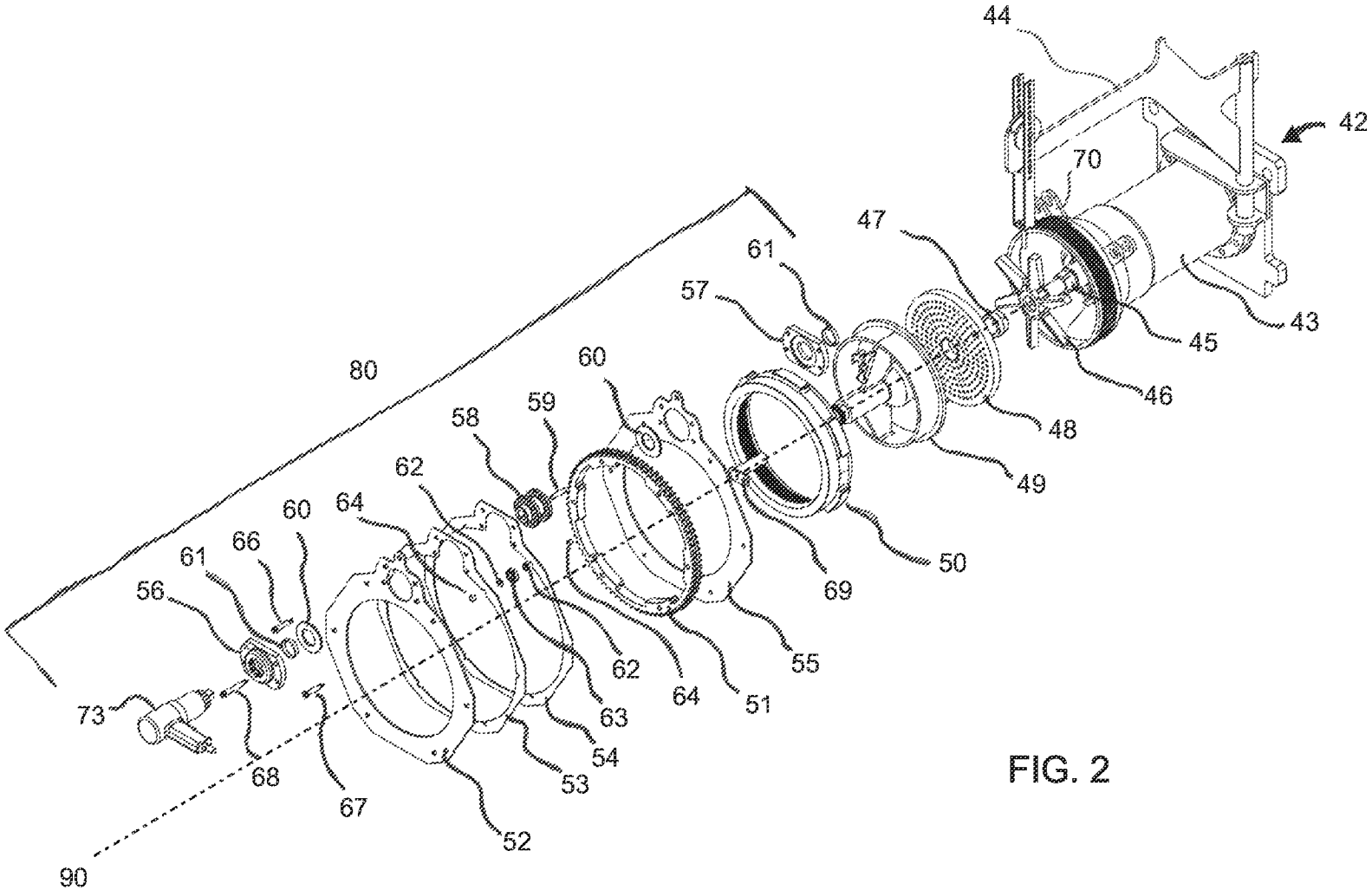
FIG. 2 is an exploded view of the primary grinder system 42 with the mounting ring installation system 80 installed.

The mounting ring installation system 80 may further comprise a front retaining plate 52, primary safety plate 53, secondary safety plate 54, and rear retainer plate 55. Spanner bolts 67 may pass through each plate 52, 53, 54, and 55. Plates 52, 53, 54, and 55 may be properly spaced apart by retainer plate spacers 64, as depicted in FIG. 2.

The mounting ring installation system 80 may further comprise spanner bearings. Spanner bearings 63 ride in a spanner groove 32 (FIGS. 5, 6) around the outside of spanner ring 51 about the central axis 90 of the grinder head 43. The spanner bearings 63 maintain proper alignment of the spanner ring 51 with the mounting ring 50 and central axis 90 of the grinder head 43. As an added safety feature, retainer plates 52, 55 may be designed with an edge to keep objects such as fingers or clothing out of pinch points around the spanner ring 51. Such edge may be one chosen from a curved edge, a tapered edge, or an angled edge.

The mounting ring installation system 80 may further comprise a mounting ring lug 36 on the peripheral portion of the mounting ring 50. As the spanner ring 51 rotates about the central axis 90 of the grinder head 43, spanner ring drive 34 engages with the side of mounting ring lug 36. As mounting ring 50 rotates about the central axis 90 of the grinder head 43, the internal threads 71 of mounting ring 50 engage with the external threads 72 of the grinder head 43 transmitting a lateral movement of mounting ring 50. This lateral movement may engage the mounting ring shoulder 37 against portion 38 of bridge 49 applying force against orifice plate 48 and properly secures orifice plate 48 into grinder head 43. In another embodiment the spanner ring 51 and the mounting ring 50 may be integrated as one component. Alternatively, the spanner ring 51 may be bolted to the mounting ring 50.

The pin gear hub 58 may include a front bearing plate 56 and a rear bearing plate 57, which may be fixed in position by four bearing plate bolts 68. Bearing plate bolts 68 pass through front bearing plate 56, then front retainer plate 52, then primary safety plate 53, then secondary safety plate 54, then rear retainer plate 55 and thread into threaded faster holes on rear bearing plate 57. Bearing plate bolts 68 may be made of a specific length to supply proper spacing between front bearing plate 56 and rear bearing plate 57.

Figure 5:
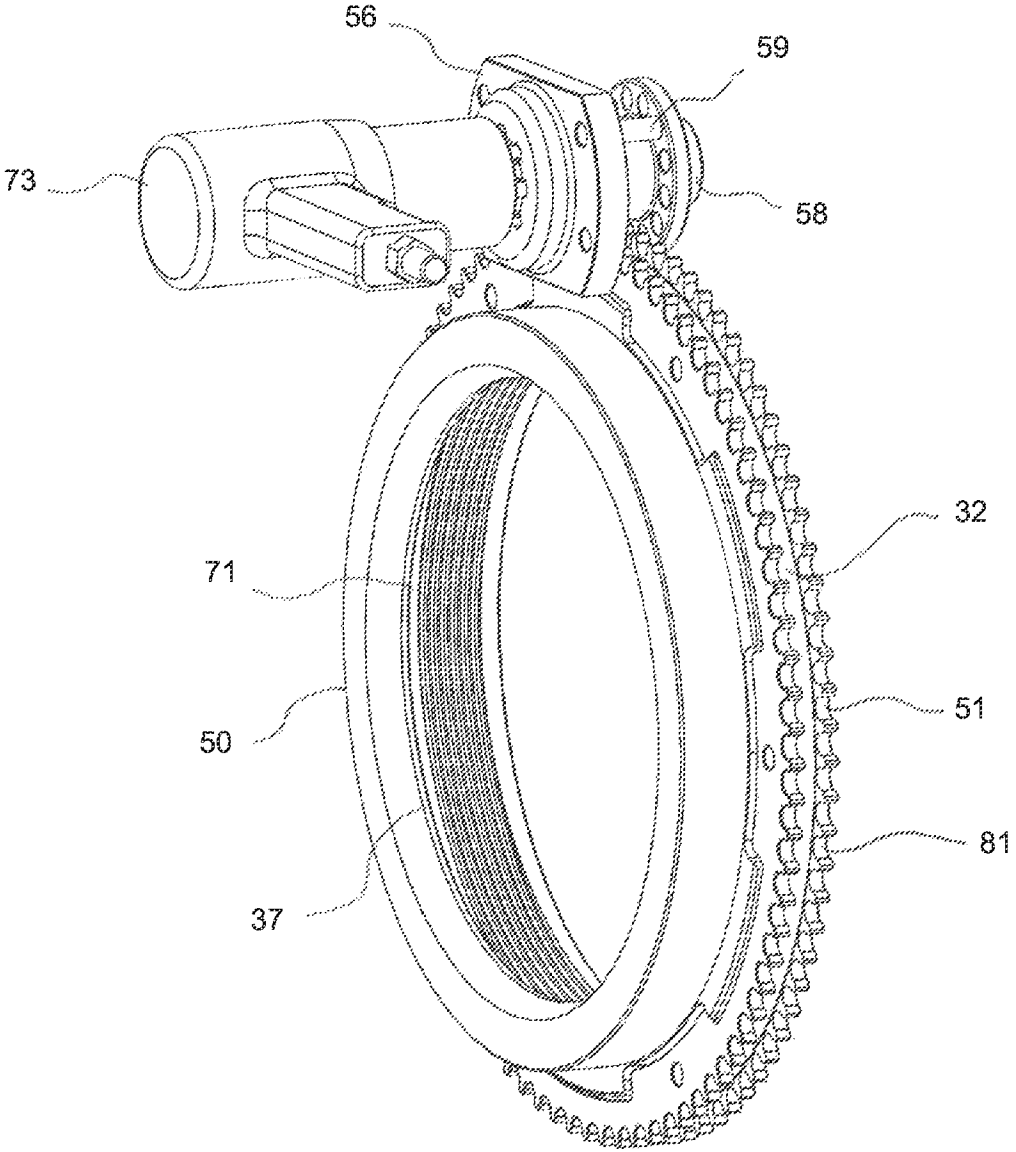
FIG. 5 is a front side perspective view of the mounting ring 50, spanner ring 51, and pin gear hub 58 relationship.

In FIG. 7, hub pin holes 79 house hub pin 59 in a series of holes positioned axially around the rotational axis 91 of the pin gear hub 58. The size of hub pin holes 79 are directly linked to the size of hub pin 59, and the size of hub pin 59 directly effects the number of hub pin holes 79 positioned axially around the rotational axis 91 of the pin gear hub 58. As shown in FIGS. 5 and 6, around the outside edge of spanner ring 51 is a series of spanner teeth 81 that inter mesh with the hub pins 59 on the pin gear hub 58. The size of the spanner teeth 81 directly corresponds with the size of the hub pin 59 on the pin gear hub 58.

Figure 8B:
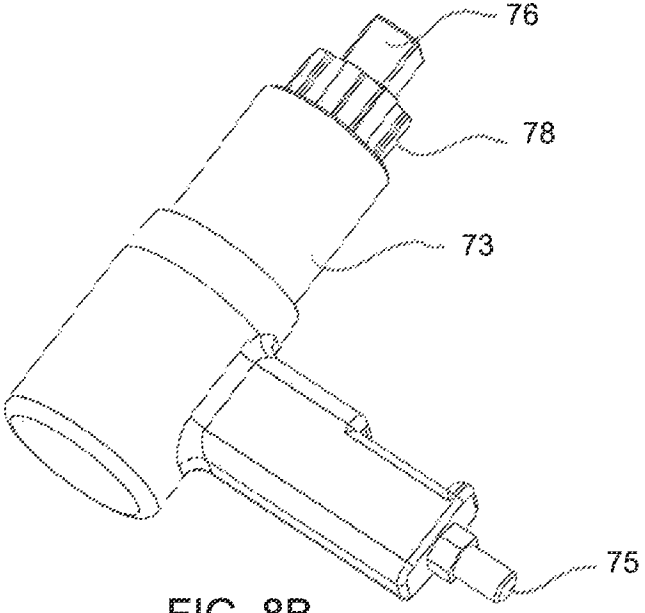
FIG. 8B is a perspective view showing a power source in the form of a torque gun 73.
Figure 8A:
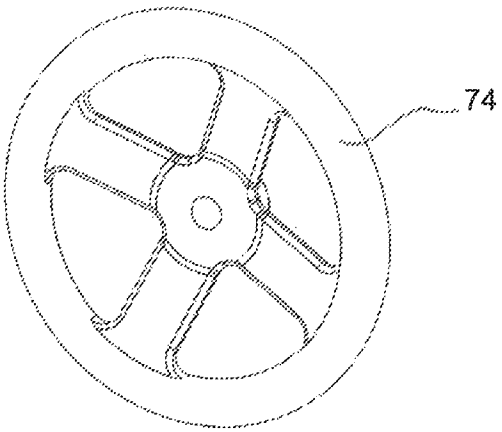
FIG. 8A is a perspective view showing a power source in the form of a hand wheel 74.

The pin gear hub 58 may include a drive feature 65. The drive feature 65 may include a square drive feature. A power source may be applied to the drive feature 65 to turn the pin gear hub 58 about its axis of rotation 91. The power source may be manual, such as a manual input hand wheel 74 as depicted for example in FIG. 8A, or electrically, pneumatically, or hydraulically powered, such as a torque gun or a pneumatic powered torque gun 73 as depicted for example in FIG. 8B. The power source may also be battery powered or powered by another source of power know by one skilled in the art. The introduction of power applied to the drive feature 65 may be secured by a fixed feature which corresponds to a spline of the power source. The fixed feature may have various optional shapes. The fixed feature may include a shape on the front bearing plate 56. In one embodiment, the power source is a torque gun 73 with a spline 78 of various optional shapes, to mesh with a corresponding fixed feature embodied as a locking spline located on the front bearing plate 56. The torque gun 73 fits into the front bearing plate 56 by meshing the torque gun spline 78 with the locking spline 77 on the front bearing plate 56. In a further embodiment, the drive feature 76 on the torque gun 73 meshes with the drive feature 65 on the pin gear hub 58.

In one embodiment, the pin gear hub 58 is held in an axial position by sleeve bearing 61 and thrust bearing 60. The sleeve bearing 61 may include a bronze sleeve bearing 61. The thrust bearing 60 may include a bronze sleeve thrust bearing 60. Sleeve bearing 61 is pressed into an axial bore feature 82 on the front bearing plate 56 and axial bore feature 81 on the rear bearing plate 57. Thrust bearing 60 is installed between the pin gear hub 58 and mating pocket 93 in front bearing plate 56 as well as the pin gear hub 58 and the mating pocket 92 in the rear bearing plate 57. The thrust bearing 60 is designed to absorb lateral movement of pin gear hub 58 as force is applied to drive feature 65 by torque gun 73.

Another aspect of the inventive embodiment is the ability to accurately apply the correct amount of rotational force to pin gear hub 58 to properly secure orifice plate 48 into grinder head 43. This rotational force may vary according to which of the various power sources is applied to pin gear hub 58.

Figure 10B:
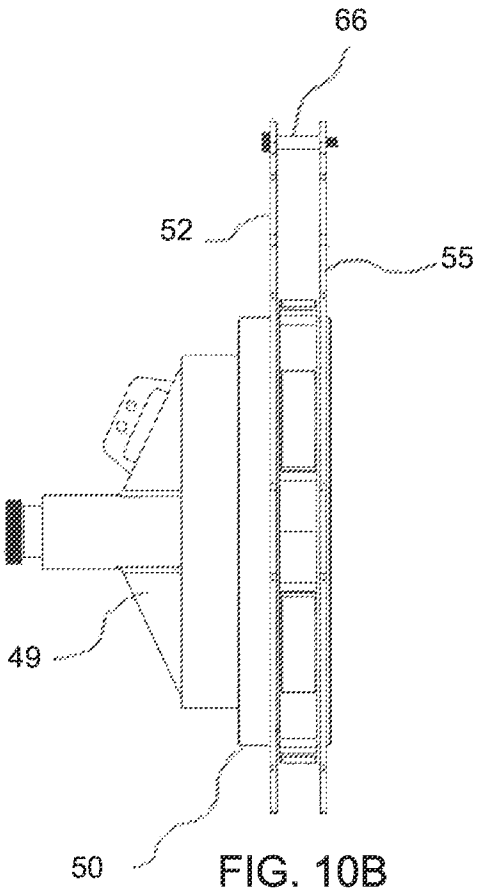
FIG. 10B is a right side perspective view illustrating the relationship between the front retainer plate 52 and rear retainer plate 55 and the mounting ring 50.
Figure 10A:
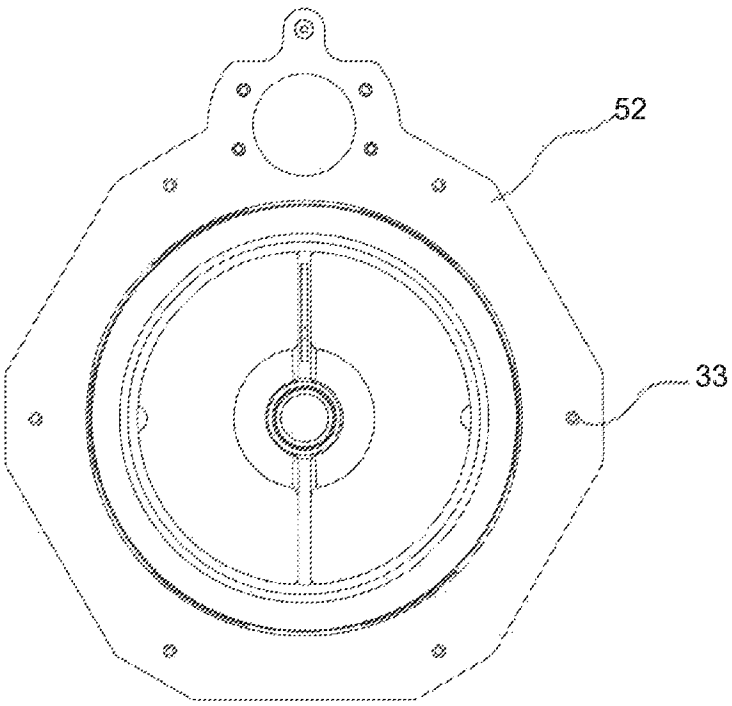
FIG. 10A is a front view illustrating the relationship between the front retainer plate 52.

Another aspect of the inventive embodiment is the relationship between mounting ring 50, front retainer plate 52, and rear retainer plate 55 displayed in FIG. 10B. In previous descriptions, it was specified that front retainer plate 52 and rear retainer plate 55 were properly spaced by bearing plate bolts 68 as well as retainer plate spacers 64 depicted in FIG. 2. The spacing between front retainer plate 52, and rear retainer plate 55 allows the mounting ring 50 to freely rotate about central axis 90 of the grinder head 43 while securing the mounting ring lugs 36 between the front retainer plate 52, and rear retainer plate 55.

A further embodiment includes a lift pin 66 that fastens the front retainer plate 52 and rear retainer plate 55 together at the balanced lifting point of the mounting ring installation system 80. As best seen in FIG. 1, the mounting ring installation system 80 may be supported and suspended and can be moved using the support device 44. The support device 44 supports the mounting ring installation system 80 during assembly, operation, disassembly and sanitation, generating safety and ease of use. Support device 44 may include a series of adjustment holes 31 allowing adjustments in height of mounting ring installation system 80 to maintain an axial alignment with grinder head 43. Support device 44 may include be a variety of shapes and sizes. Support device 44 allows for support and adjustment of the mounting ring installation system 80.

Figure 9:
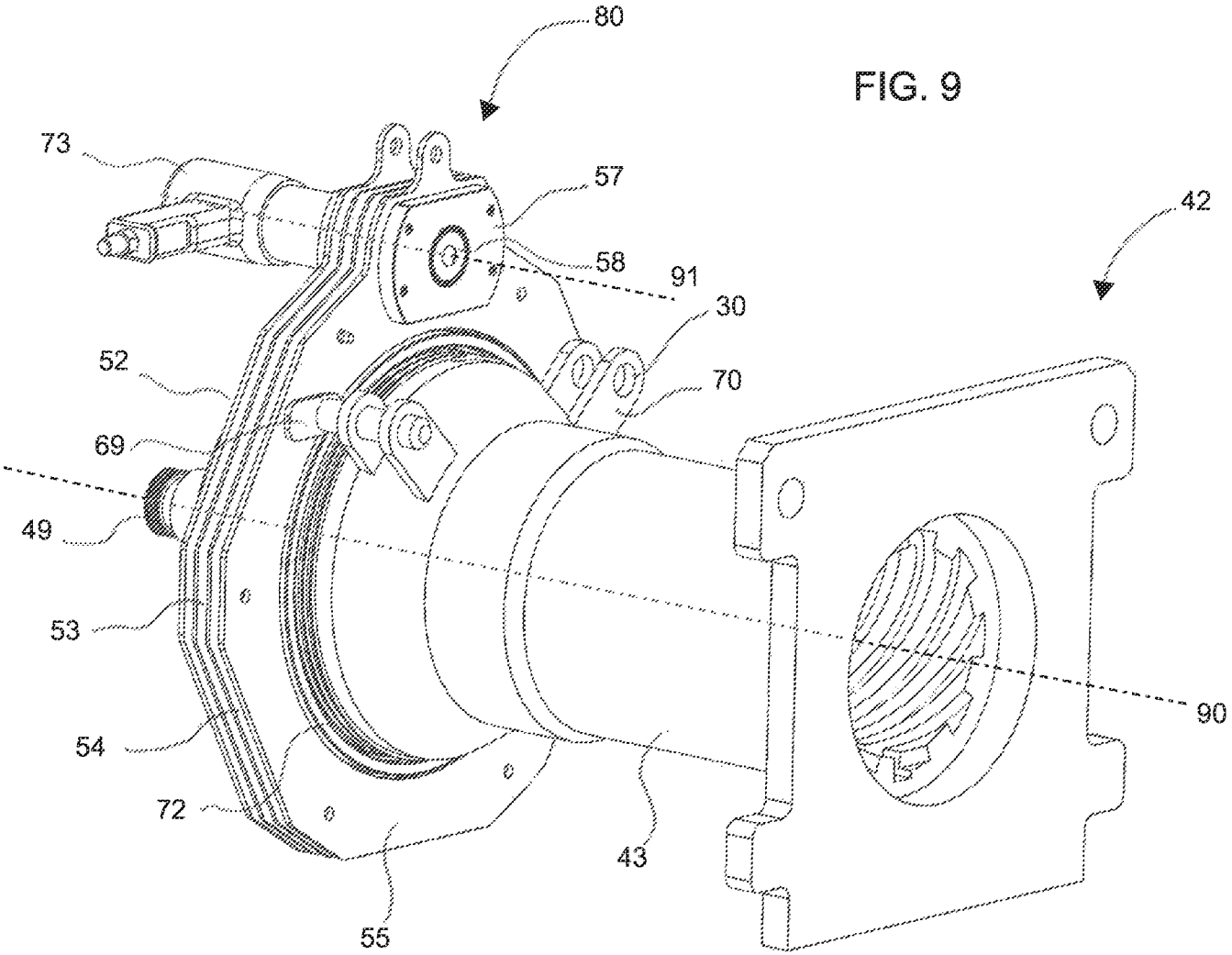
FIG. 9 is a rear side perspective view of the primary grinding system 42 with the mounting ring installation system 80 installed and, in particular, illustrating the relationship between the lock pin 69 and the tightening ear 70 on the primary grinding system.

At least one of a lock pin 69 and tightening ear 70 may also be included, as shown for example in FIG. 9. Lock pin 69 may be fastened to rear retainer plate 55 by means of bolting or welding, or another means of fastening chosen by one skilled in the art. Tightening ear 70 can be fastened to the grinder head 43 by means of welding or bolting. Lock pin 69 is fastened to rear retainer plate 55 and protrudes through the pin bore 30 in tightening ear 70. Pin bore 30 can be of various shapes and sizes to accommodate various shapes and sizes of grinder heads 43. Lock pin 69 provides an anti-rotational mechanical device for the mounting ring installation system 80. As rotational force is applied to the pin gear hub 58, and then to the spanner ring 51 through spanner teeth 81, then to mounting ring lug 36, the mounting ring installation system 80 may start to rotate the same direction as the original rotational force applied to the pin gear hub 58 around the central axis 90 of grinder head 43. Lock pin 69 prevents the mounting ring installation system 80 from completing that rotation.

As described in the preferred embodiments of the invention best seen in FIG. 1, the mounting ring installation system 80 is supported and suspended and can be moved using the support device 44. The support device 44 supports the mounting ring installation system 80 during assembly, operation, disassembly and sanitation, generating safety and ease of use. As is known by one skilled in the art, the mounting ring is commonly loosened and tightened by the person assembling and disassembling the grinder throughout a production cycle to meet safety and regulatory standards. As noted on page 11 front retainer plate 52, primary safety plate 53, secondary safety plate 54, and rear retainer plate 55 are properly spaced apart by retainer plate spacers 64 (FIG. 2). This proper spacing of plates allows for the mounting ring installation system 80 to be removed using pneumatic torque gun 73 and allowed to be suspended by support device 44 for proper sanitation at the end of each production run. Mounting ring installation system 80 is designed in a manner that prevents the need from the system being taken apart for sanitation due to proper spacing and design. Proper maintenance on the mounting ring installation system 80 includes quarterly preventative maintenance on visual components such as details 69, 56, 57, 77, 66, 67, 71, 59, 44. A more detailed yearly inspection needs to be performed by qualified individuals to inspect details 58, 51, 61, 60, 50, 73, 63, 62. To perform the quarterly PM's the mounting ring installation system 80 does not need to be removed from the support device 44. To perform the yearly detailed inspection the mounting ring installation device 80 does need to be removed from support device 44 and taken apart on a work bench.

What is claimed is:

1. A mounting ring installation system for a meat grinder comprising:

a grinder head located circumferentially around a central axis and including a series of external threads;

a mounting ring having a radially outer surface and including a series of internal threads which selectably engage with the series of external threads of the grinder head to selectably attach the mounting ring to the grinder head about the central axis of the grinder head; and a spanner ring having radially outer and inner surfaces and positioned circumferentially on the grinder head about its central axis, wherein the spanner ring includes a plurality of spanner teeth arranged circumferentially about the radially outer surface of the spanner ring; and wherein the mounting ring engages with the spanner ring, such that when a force is applied to the spanner ring, the spanner ring rotates about the central axis of the grinder head and rotates the mounting ring.

2. The mounting ring installation system according to claim 1, wherein the force is one chosen from a circumferential force, a radial force, and a tangential force supplied by at least one chosen from a gear, a cylinder, a pump, a valve, and a motor.

3. The mounting ring installation system according to claim 1, wherein the spanner ring and the mounting ring are an integrated structure or fastened together.

4. The mounting ring installation system according to claim 1, further comprising:

a pin hub gear having an axis of rotation, the pin hub gear being rotatable about the axis of rotation;

a front bearing plate including a receiver arranged axially in front of the pin hub gear with respect to the pin hub gear axis of rotation;

at least one hub pin positioned axially between the pin hub gear and the front bearing plate, wherein upon rotation of the pin hub gear about the pin hub gear axis of rotation the at least one hub pin being positioned between at least two of the plurality of spanner teeth, wherein the rotational force is applied to the receiver about the pin hub gear axis of rotation to rotate the pin hub gear and the hub pin about the pin hub gear axis of rotation and wherein the hub pin engages the spanner ring, fitting between the at least two of the plurality of spanner teeth to rotate the spanner ring about the axis of rotation of the grinder head; and wherein the mounting lug at the radially outer surface of the mounting ring engages with the spanner ring drive on a radially inner surface of the spanner ring to rotate the mounting ring.

5. The mounting ring installation system according to claim 4, further comprising:

a rear bearing plate located axially behind the pin hub gear;

a forward thrust bearing located axially forward of the pin hub gear and axially between the pin hub gear and the front bearing plate, wherein the forward thrust bearing includes a sleeve bearing a portion of which is positioned axially inside the front bearing plate;

a rear thrust bearing located axially between the rear bearing plate and the pin hub gear, wherein the rear thrust bearing includes a rear sleeve bearing a portion of which is positioned axially inside the rear bearing plate; and wherein the front bearing plate and the rear bearing plate are connected and wherein the hub pin gear rotates freely about the hub pin gear axis of rotation relative to the front bearing plate and the rear bearing plate.

6. The mounting ring installation system according to claim 4, further comprising:

a rear bearing plate located axially behind the pin hub gear;

a front retainer plate located axially in front of the spanner ring and radially around the mounting ring;

a rear retainer plate located axially behind the spanner ring and radially around the mounting ring; and wherein the pin hub gear is located between the front bearing plate and the rear bearing plate, wherein the front bearing plate is mounted to the front retainer plate, and wherein the rear bearing plate is mounted to the rear retainer plate.

7. The mounting ring installation system according to claim 6, further comprising:

a lift pin which selectably engages with a front retainer plate and a rear retainer plate; and a support on which the mounting ring installation system is supported and suspended, wherein the support attaches to the lift pin.

8. The mounting ring installation system according to claim 6, wherein either the front retainer plate or the rear retainer plate includes one chosen from an edge chosen from at least one of a curved edge, a tapered edge, or an angled edge.

9. The mounting ring installation system according to claim 6, further comprising:

a spanner bolt;

a primary safety plate located axially between the front retainer plate and the rear retainer plate and around the spanner ring; and wherein the spanner bolt passes through the front retainer plate, the primary safety plate, and the rear retainer plate.

10. The mounting ring installation system according to claim 9, further comprising:

a spanner bolt;

a secondary safety plate located axially between the front retainer plate and the rear retainer plate and around the spanner ring; and wherein the spanner bolt passes through the front retainer plate, the primary safety plate, the secondary safety plate, and the rear retainer plate.

11. The mounting ring installation system according to claim 4, wherein the pin hub gear includes at least one front pin hole and at least one rear pin hole, wherein the hub pin is located in the at least one front pin hole and the at least one rear pin hole.

12. The mounting ring installation system according to claim 4, wherein the receiver is a square shaped receiver and wherein the front bearing plate includes a locking spline, and wherein the rotation force includes:

a square drive which is received in the square shaped receiver; and a spline which corresponding to the shape of the locking spline to lock the rotational force in place relative to the front bearing plate.

13. The mounting ring installation system according to claim 1, further comprising:

at least one spanner bolt;

a spanner groove;

at least one spanner bearing;

wherein the at least one spanner bolt attaches the at least one spanner bearing to the spanner ring; and wherein the at least one spanner bearing rides the spanner groove around an outer edge of the spanner ring.

14. The mounting ring installation system according to claim 1, further comprising:

a rear retainer plate including a lock pin;

wherein the grinder head further comprises a tightening ear;

wherein the lock pin and the tightening ear engage to prevent rotation about the rotational axis of the grinder head.

15. The mounting ring installation system according to claim 1, wherein the force is at least one chosen from an electrically powered, a manually powered, a pneumatic, and a hydraulic force; and wherein the force is supplied by at least one chosen from a torque gun, a pneumatic or a hydraulic cylinder, a hand wheel, and a crank.

16. The mounting ring installation system according to claim 1, wherein the mounting ring includes a mounting lug arranged at the radially outer surface of the mounting ring with respect to the central axis of the grinder head, wherein the spanner ring includes a spanner ring drive located on the radially inner surface of the spanner ring; and wherein the mounting lug at the radially outer surface of the mounting ring engages with the spanner ring drive at the radially inner surface of the spanner ring.

17. A method of disassembling a grinding system, comprising:

Providing:

a grinder head located circumferentially around a central axis and including a series of external threads;

a mounting ring assembly including a mounting ring having a radially outer surface and including a series of internal threads which selectably engage with the series of external threads of the grinder head to selectably attach the mounting ring to the grinder head about the central axis of the grinder head; and a spanner ring having radially outer and inner surfaces and positioned circumferentially on the grinder head about its central axis, wherein the spanner ring includes a plurality of spanner teeth arranged circumferentially about the radially outer surface of the spanner ring;

wherein the mounting ring engages with the spanner ring, such that when a force is applied to the spanner ring, the spanner ring rotates about the central axis of the grinder head and rotates the mounting ring; and a support on which the mounting ring assembly is supported and suspended;

rotating the mounting ring to disengage the internal threads of the mounting ring with the external threads of the grinder head; and moving the mounting ring assembly away from the grinder head, wherein the mounting ring remains suspended by the support.

18. The method of disassembling the grinding system according to claim 17, wherein the force applied to the spanner ring is one chosen from a circumferential, linear, or tangential force to rotate the spanner ring about the axis of rotation of the grinder head, engaging the mounting ring lug and rotating the mounting ring about the axis of rotation of the grinder head.

19. The method of disassembling the grinding system according to claim 17, further comprising:

providing the mounting ring assembly further comprising:

a spanner ring having radially outer and inner surfaces and positioned circumferentially on the grinder head about its axis of rotation, wherein the spanner ring includes:

a spanner ring drive on the radially inner surface of the spanner ring; and a plurality of spanner teeth arranged circumferentially about the radially outer surface of the spanner ring;

a pin hub gear having an axis of rotation, the pin hub gear being rotatable about its axis of rotation, and wherein the pin hub gear is located radially outside the mounting ring;

at least one hub pin; and wherein the mounting ring includes a mounting lug; and applying a rotational force to rotate the pin hub gear about its axis of rotation to engage the at least one hub pin with the spanner teach to rotate the spanner ring about the axis of rotation of the grinder head.

20. The method of disassembling the grinding system according to claim 19, wherein the pin hub gear further comprises a front bearing plate including a receiver, and wherein the rotational force to rotate the pin hub gear is applied to the receiver.

* * * * *